US006649855B2

(12) United States Patent
Nishijima et al.

(10) Patent No.: US 6,649,855 B2
(45) Date of Patent: Nov. 18, 2003

(54) CONTACT ARRANGEMENT FOR VACUUM INTERRUPTER AND VACUUM INTERRUPTER USING THE CONTACT ARRANGEMENT

(75) Inventors: Akira Nishijima, Shizuoka (JP); Hidemitsu Takebuchi, Chiba (JP); Yoshihiko Matsui, Shizuoka (JP)

(73) Assignee: Kabushiki Kaisha Meidensha, Tokyo (JP)

( * ) Notice: Subject to any disclaimer, the term of this patent is extended or adjusted under 35 U.S.C. 154(b) by 0 days.

(21) Appl. No.: 10/238,897

(22) Filed: Sep. 11, 2002

(65) Prior Publication Data

US 2003/0066743 A1 Apr. 10, 2003

(30) Foreign Application Priority Data

Sep. 12, 2001 (JP) ..... 2001-276171

(51) Int. Cl.[7] ..... H01H 33/66
(52) U.S. Cl. ..... 218/128; 218/123; 218/129
(58) Field of Search ..... 218/123, 124, 218/125–128

(56) References Cited

U.S. PATENT DOCUMENTS 4,532,391 A * 7/1985 Bernt ..... 218/128
4,620,074 A 10/1986 Paul et al.
5,064,976 A 11/1991 Bialkowski et al.
5,313,030 A * 5/1994 Kusserow et al. ..... 218/136
5,691,522 A * 11/1997 Schulman et al. ..... 218/128
5,804,788 A 9/1998 Smith

FOREIGN PATENT DOCUMENTS

DE 37 24 813 A1 2/1989
JP 3-59531 9/1991

OTHER PUBLICATIONS

U.S. patent application Ser. No. 10/238,900, Matsui et al., filed Sep. 11, 2002.
U.S. patent application Ser. No. 10/238,901, Nishijima et al., filed Sep. 11, 2002.

* cited by examiner

*Primary Examiner*—Elvin Enad
*Assistant Examiner*—M. Fishman
(74) *Attorney, Agent, or Firm*—Foley & Lardner

(57) ABSTRACT

In a contact arrangement and a vacuum interrupter using the contact arrangement, the contact arrangement includes: a hollow cylindrical contact carrier on one end surface of which a contact plate is attached; a plurality of first slits formed on the contact carrier from the one end surface of the contact carrier; and a plurality of second slits formed on the contact carrier from each predetermined point of midway through an axial direction of the contact carrier, each of the first and second slits being tilted with respect to the axial direction of the contact carrier, a coil portion being formed on a portion of the hollow cylindrical contact carrier between each of the first and second slits and an adjacent one of the first and second slits and a longitudinal magnetic field being formed along the axial direction of the contact carrier by a current flowing on the coil portion.

17 Claims, 5 Drawing Sheets

CONTACT ARRANGEMENT FOR VACUUM INTERRUPTER AND VACUUM INTERRUPTER USING THE CONTACT ARRANGEMENT

BACKGROUND OF THE INVENTION

1. Field of the Invention

The present invention relates to a contact arrangement for a vacuum interrupter (or called, a vacuum switch) and the vacuum interrupter using the contact arrangement.

2. Description of the Related Art

In order to improve a breaking capacity (or interruption performance) of such a kind of vacuum interrupter as described above, it is necessary to receive arc with a whole surface of each contact without a concentration of the arc developed in a gap between both of contacts during a power interruption on a single portion of each contact electrode.

A longitudinal magnetic field application system (viz., a technique of providing coil electrodes to apply a magnetic field in an axial direction parallel to an axis of the arc generated between a pair of contact electrodes during an interruption) has been adopted in such a vacuum interrupter as described above.

The generated arc is enclosed by the magnetic field when the longitudinal magnetic field is applied across the contact electrodes. A loss from an arc column of charge particles becomes reduced, the arc becomes stable, a temperature rise in the contact electrodes is suppressed, and the breaking capacity is improved.

A Japanese Patent Application Second (Examined) Publication No. Heisei 3-59531 published on Sep. 10, 1991 (which corresponds to a U.S. Pat. No. 4,620,074 issued on Oct. 28, 1986) exemplifies a previously proposed vacuum switch in which the longitudinal magnetic field application system has been adopted. In the above-described Japanese Patent Application Second Publication, a hollow cylindrical contact carrier for supporting a contact plate having a cup depth is provided for each of a pair of cup-type contact electrode, the contact electrodes are arranged coaxially opposite to each other, and each contact carrier has a plurality of slots (or called, a plurality of slits) inclined in the same sense with respect to a longitudinal axis of each contact electrode. Then, a cup depth, the number of slots, and an azimuth angle of each of the slots are prescribed.

SUMMARY OF THE INVENTION

However, if the previously proposed vacuum switch disclosed in the above-described Japanese Patent Application Second Publication, the arcs developed between the contact electrodes become unstable due to an insufficient magnetic flux density between the contact electrodes and, in worst case, the contact electrodes cannot interrupt the power. In addition, if the azimuth angle of each of the slits formed on the contact carrier is considerably widened, a mechanical strength of each contact electrode itself becomes insufficient. Then, if each contact electrode is deformed due to an operational force of opening (disconnecting) or closing (connecting) each contact electrode so that a voltage withstanding characteristic and a power interruption characteristic might be worsened.

It is, hence, an object of the present invention to provide a contact arrangement for a vacuum interrupter and vacuum interrupter using the contact arrangement in which the longitudinal magnetic field application system is adopted and which are favorable in the voltage withstanding characteristic and power interruption characteristic even if the diameter of each contact electrode and the separation distance therebetween are widened.

According to one aspect of the present invention, there is provided a contact arrangement for a vacuum interrupter, comprising: a hollow cylindrical contact carrier on one end surface of which a contact plate is attached; a plurality of first slits formed on the contact carrier from the one end surface of the contact carrier; and a plurality of second slits formed on the contact carrier from each predetermined point of midway through an axial direction of the contact carrier, each of the first and second slits being tilted with respect to the axial direction of the contact carrier, a coil portion being formed on a portion of the hollow cylindrical contact carrier between each of the first and second slits and an adjacent one of the first and second slits, and a longitudinal magnetic field being formed along the axial direction of the contact carrier by a current flowing on the coil portion.

According to another aspect of the present invention, there is provided a vacuum interrupter having a pair of contact electrodes arranged on the same axis in an evacuated envelope in a manner to connect or disconnect with each other by respective electrode rods, at least one contact electrode comprising: a hollow cylindrical contact carrier on one end surface of which a contact plate is attached; a plurality of first slits formed on the contact carrier from the one end surface of the contact carrier; and a plurality of second slits formed on the contact carrier from each predetermined point of midway through an axial direction of the contact carrier, each of the first and second slits being tilted with respect to the axial direction of the contact carrier, a coil portion being formed on a portion of the hollow cylindrical contact carrier between each of the first and second slits and an adjacent one of the first and second slits, and a longitudinal magnetic field being formed along the axial direction of the contact carrier by a current flowing on the coil portion.

This summary of the invention does not necessarily describe all necessary features so that the invention may also be a sub-combination of these described features.

DETAILED DESCRIPTION OF THE PREFERRED EMBODIMENTS

Reference will hereinafter be made to the drawings in order to facilitate a better understanding of the present invention.

Figure 1:
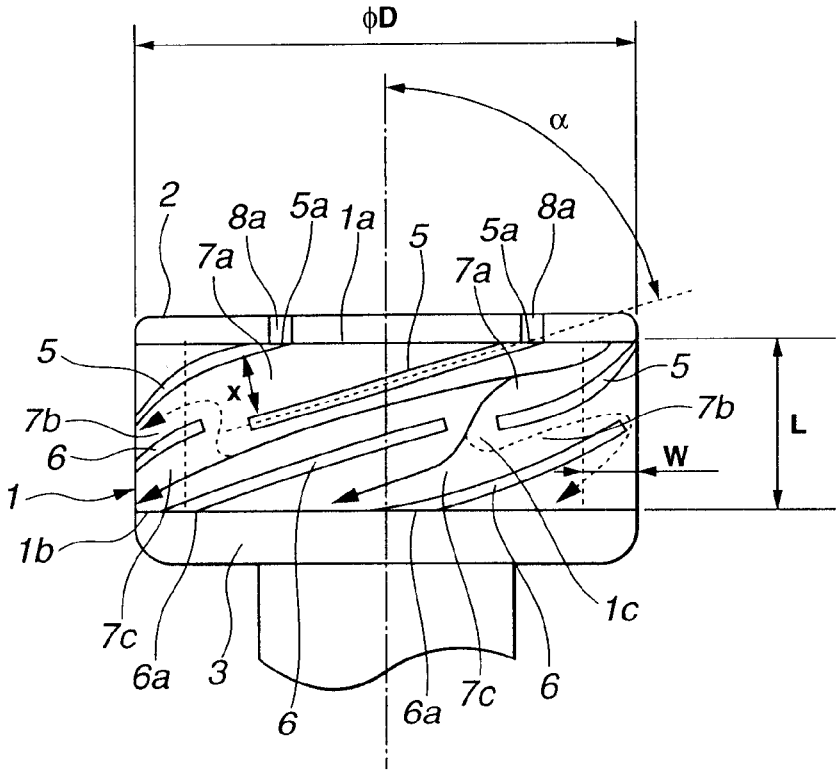
FIG. 1 is a side view of a contact arrangement used for one of a pair of contact electrodes of a vacuum interrupter in a preferred embodiment according to the present invention.
Figure 2:
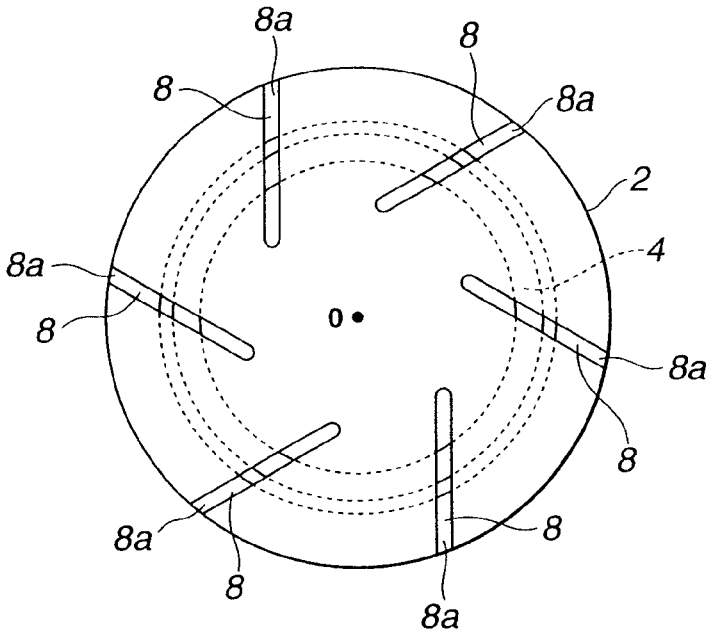
FIG. 2 is a top plan view of the contact arrangement used for the one of the pair of contact electrodes of the vacuum interrupter shown in FIG. 1.
Figure 3:
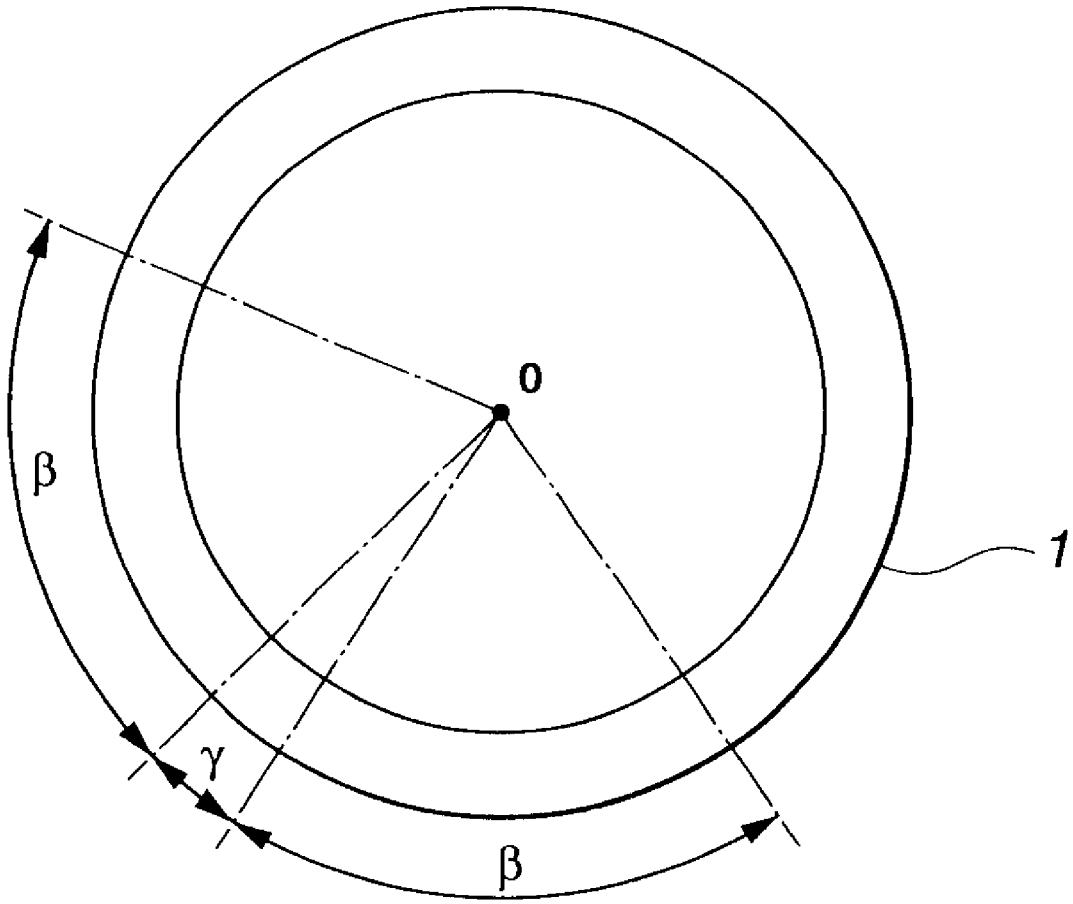
FIG. 3 is an explanatory view of azimuth angles on slits formed on the one of the pair of contact electrodes of the vacuum interrupter shown in FIG. 1.
Figure 4:
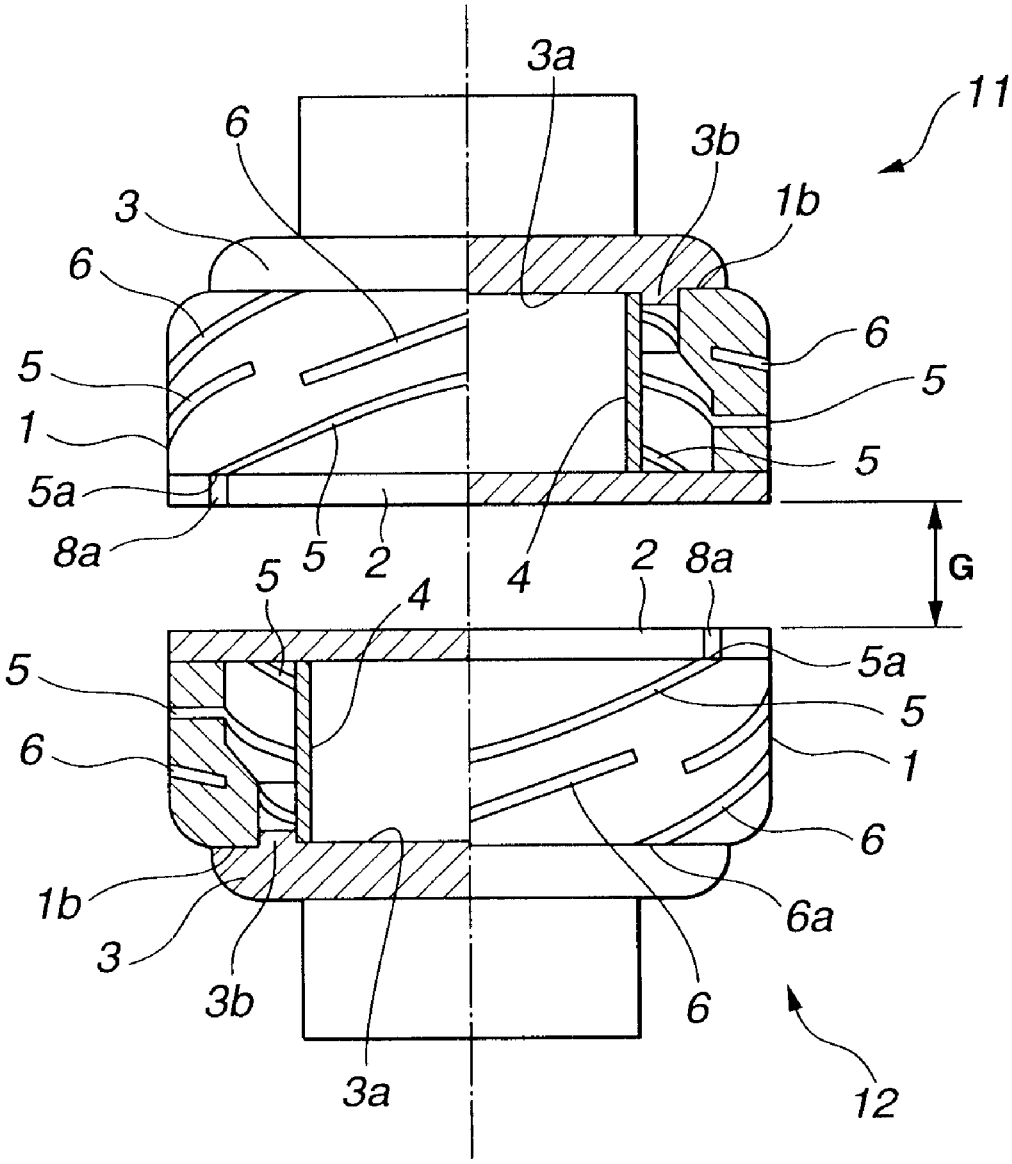
FIG. 4 is a partially cross sectional side view of the pair of contact electrodes when one of the pair of contact electrodes is opposed against the other of the pair of contact electrodes of the vacuum interrupter shown in FIG. 1.
Figure 5:
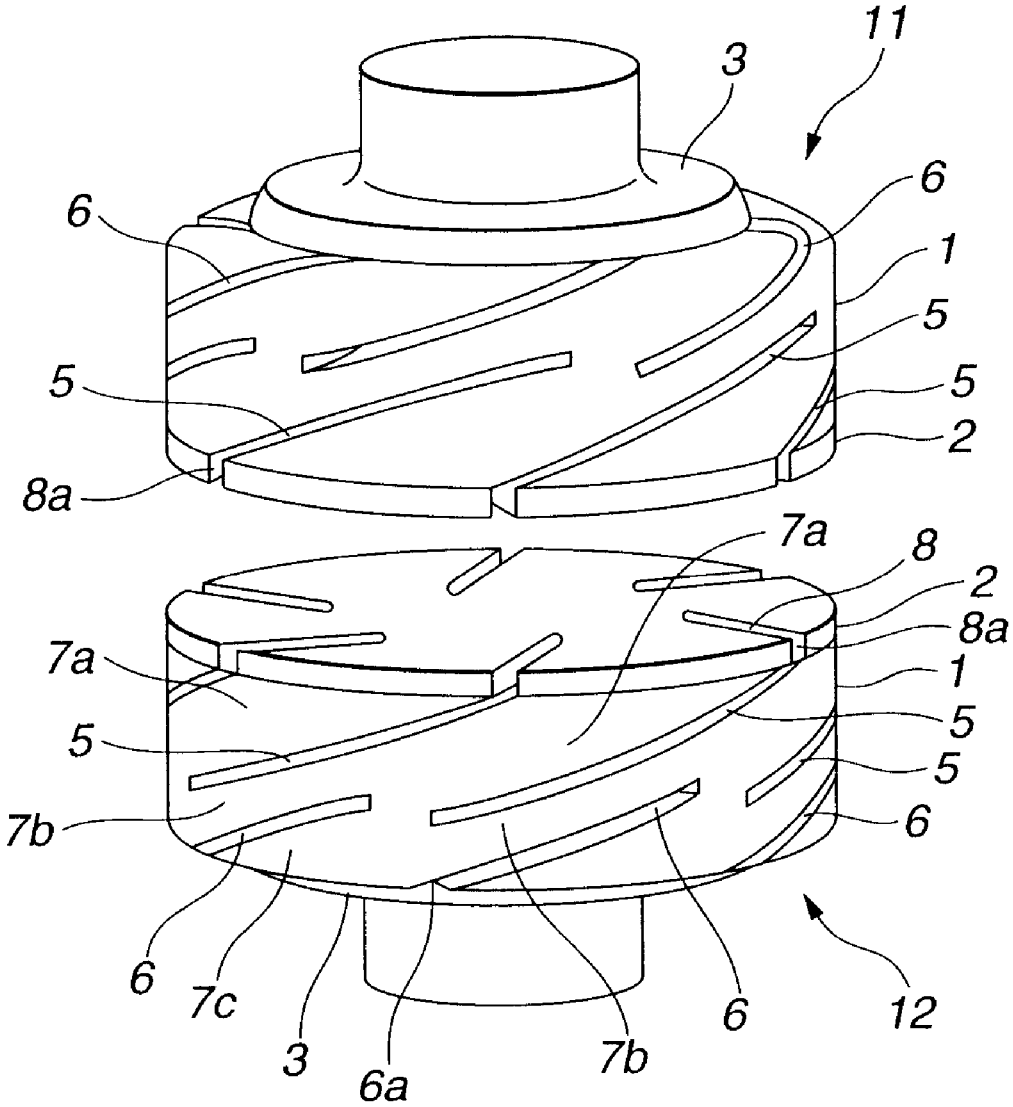
FIG. 5 is a perspective view of the pair of contact electrodes using the contact arrangement and which are mutually opposed against each other as shown in FIG. 4.

FIG. 2 shows a side view of one of a pair of contacts (a contact arrangement) to be used as a pair of contact electrodes of a vacuum interrupter according to the present invention. FIG. 2 shows a top view of the corresponding contact electrode shown in FIG. 1. FIG. 3 shows azimuth angles β and γ in the case of one of the pair of contact electrodes shown in FIG. 2. FIGS. 4 and 5 show the pair of contact electrodes mutually opposed against each other. A contact plate 2 is brazed to one end surface 1*a* of a hollow cylindrical contact carrier 1. A contact end plate 3 to which a lead rod (or called electrode rod) is to be connected is brazed to the other end surface 1*b* of contact carrier 1. In this embodiment, a ring-shaped fitting portion 3*b* is formed on a surface 3*a* of contact end plate 3. This ring-shaped fitting 3*b* is fitted and brazed to an inside of hollow cylindrical contact carrier 1. On end of a cylindrical reinforcement body 4 is fitted into and brazed to an inside surface of hollow cylindrical contact carrier 1. Contact plate 2 attached onto end surface 1*a* of contact carrier 1 is contacted against and brazed into the end surface of reinforcement body 4. In details, cylindrical reinforcement body 4 serves to reinforce contact plate 2 and contact carrier 1 so as to prevent these elements from being deformed. It is noted that each first and second slits 5 and 6 is extended from an outer surface of contact carrier 1 to an inner surface of contact carrier 1. It is also noted that each contact electrode is called a cup-shaped contact since hollow cylindrical contact carrier 1 and contact end plate 3 are combined to form, so-called, a cup.

A diameter D of contact carrier 1 is selected to a value in a range of 60 mm≦D≦200 mm according to an interrupt current and voltage. This value range is based on a result of an interrupt current test. A length (cup depth) L of contact carrier 1 is set in a range of 0.2 D mm≦L≦D mm. This value is determined according to a tilt angle α and azimuth angle β as will be described later. In addition, a wall thickness W of contact carrier 1 is set to a value in a range of 6 mm≦W≦12 mm. This is a range determined with a mechanical strength of contact carrier or so on taken into consideration.

Wall thickness W of contact carrier 1 is uniform over a whole length (refer to FIG. 1). However, in a meaning of the reinforcement, a variation in a thickness value of a range of 6 mm≦W≦12 mm may be set.

First slit 5 and second slit 6, each of which being tilted through an inclination angle (tilt angle) α with respect to an axial line (axial direction) of contact carrier 1, are formed over a whole peripheral surface of contact carrier 1. In other words, each first slit 5 is opened on one end surface 1*a* of contact carrier 1. In FIG. 1, reference numeral 5*a* denotes an opening portion. Each second slit 6 is formed from other end surface 1*b* of contact carrier 1 to a predetermined point of midway (a middle point) through the axial direction of contact carrier 1. Each second slit 6 is opened on the other end surface 1*b* of contact carrier 1. In FIG. 1, reference numeral 6*a* denotes an opening portion. Azimuth angle β which is an opening angle with respect to a center 0 of contact carrier 1 of each arc-shaped slit 5, 6 is made constant. A portion of contact carrier 1 sandwiched between these slits 5 and 6 provide a coil portion. In other words, these coil portions are formed, viz., a first coil portion 7*a* is formed between mutually adjacent first slits 5, a second coil portion 7*b* is formed between first slit 5 and second slit 6, a third coil portion 7*c* is formed between mutually adjacent second slits 6. A total number of first and second slits is set in a range as 0.1 D/mm≦S≦0.2 D/mm. Hence, the number of first and second slits 5 and 6 is half S. Tilt angle α of each of first and second slits 5 and 6 is set to a value in a range of 60°≦α≦80°. This range is determined with a mechanical strength of contact carrier 1 and reduction in resistance taken into consideration. That is to say, in order to secure the mechanical strength and to reduce the resistance, a distance x (refer to FIG. 1) in a vertical direction between mutually adjacent slits 5, between first and second slits 5 and 6, and mutually adjacent slits 6 may approximately 7 to 18 mm. Then, tilt angle α is set to a value in a range of 60°≧α≧80° according to diameter D of contact carrier 1 and the number of slits S.

Azimuth angle β of each slit 5 and 6 is set to a value in a range of (540/s)°≦β≦(1440/s)°. A reason of setting a lower limit value as (540/S)° is that a length of each coil portion is set to 1.5 turn. If azimuth angle β is below this lower limit value, a magnetic flux of each coil portion becomes insufficient. A reason that an upper limit value of the above-described range is set to (1440/S)° is that a length of each coil portion is 4 turn. If the azimuth angle β is wider than the upper limit value described above, the resistance becomes excessively large and inconvenience due to an excessive heat thereon occurs. In addition, the mechanical strength of contact carrier 1 becomes lowered.

Each of first slit 5 is arranged in a mutually equal interval of distance to an adjacent one of first slits 5. Each of second slits 6 is also arranged in the mutually equal interval of distance to an adjacent one of second slits 6. A predetermined interval of angular distance γ (also called azimuth angle and refer to FIG. 3) is provided in a circumferential direction of contact carrier 1 between each of first slits 5 and adjacent one of second slits 6. This azimuth angle γ is set to a value in a range of (120/S)°≦γ≦(600/S)°. This range is determined in terms of the mechanical strength in contact carrier 1.

Since each slit 5 and 6 is shortened and the predetermined interval of distance (azimuth angle) γ is formed between each of the first slits 5 and opposing one of second slits 6, a no-hollow column portion 1*c* (refer to FIG. 1) is formed between each of the first slits 5 and opposing one of the second slits. This column portion 1*c* serves to maintain the strength in the axial direction of contact carrier 1. In order words, although the strength in the axial direction of contact carrier 1 becomes low due to the provision of the slits in the circumferential direction, the provision of the column portion 1*c* between each of first slits 5 and second slits 6 serves to maintain the strength in the axial direction of contact carrier 1.

It is noted that a predetermined short range of each of first and second slits 5 and 6 in the axial direction of contact carrier 1 is slightly overlapped on each other. Each of end portions of second slits 6 may slightly (or shallowly) be exposed to a space of contact carrier 1 between mutually adjacent two of first slits 5 (as typically shown in FIG. 1 or FIG. 4). Straight line formed (third) slits 8 are formed on contact plate 2 as shown in FIG. 2. The number of straight line formed slits 8 is the same as that of first slits 5. An extended line passing through each of straight line formed slits 8 is deviated from center O of contact plate 2 so that straight line formed slits 8 are formed spirally as viewed from FIG. 2.

Contact plate 2 is attached onto contact carrier 1 in such a manner that ends 8*a* of straight line formed slits 8 located at the circumferential surface side of contact plate 2 are mated with corresponding opening portions 5*a* of first slits 5. That is to say, contact plate 2 is formed so that each slit 8 is connected with a corresponding one of first slits 5.

it is also noted that, in the above-described embodiment, contact end plate 3 is joined to the other end side of contact carrier 1. However, a portion corresponding to contact end plate 3 may integrally be formed in a cup shape. In this case, second slits 6 are formed with a position corresponding to an inner bottom surface of contact carrier as a reference position. It is noted that a depth (cup depth) of a cup shaped integrated article corresponds to a length L of contact carrier 1.

Figure 6:
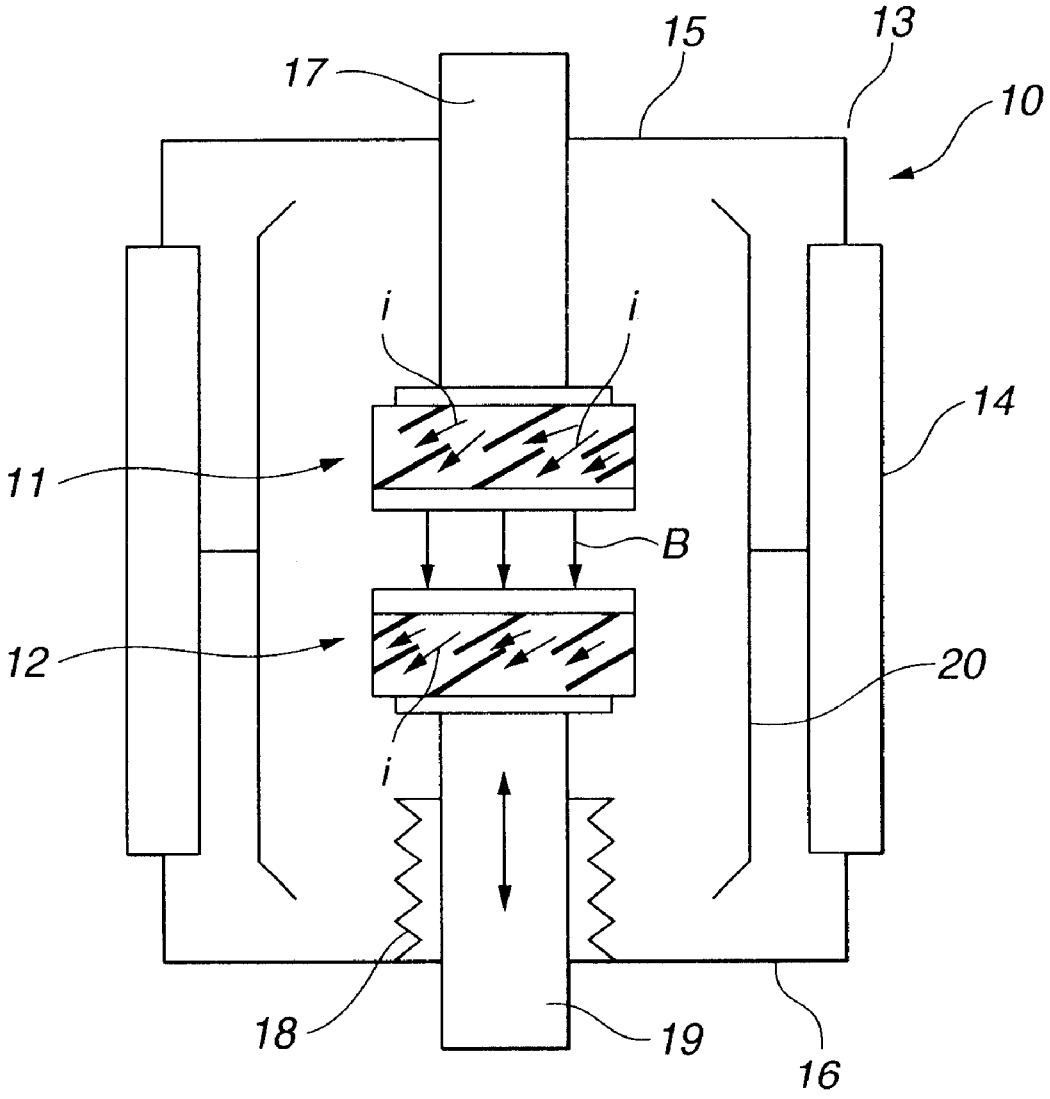
FIG. 6 is a rough configuration view of the vacuum interrupter in which the contact arrangement shown in FIG. 1 is used

FIG. 6 shows a rough configuration of a vacuum interrupter constructed using the contact arrangement described above.

Two vacuum interrupter contacts 11 and 12 shown in FIGS. 1 through 3 are opposed in the same axle with a predetermined gap (inter-contact distance) G provided as shown in FIGS. 4 and 5 and are inserted within a vacuum vessel 13 so as to construct a vacuum interrupter 10. Inter-contact distance G is set in a range over 15 mm≦G≦100 mm determined empirically according to a voltage class to be applied across vacuum interrupter 10. Vacuum vessel 13 is constructed as follows: That is to say, both ends of an insulating envelope 14 made of a ceramic or glass are enclosed with end plates 15 and 16 each made of a metal, and an inside of insulating envelope 14 is evacuated in a high vacuum state. One contact 11 is fixed as a stationary electrode rod 17 fixed through one end plate 15 of vacuum vessel 13. The other contact 12 is fixed as a movable electrode to a tip of a movable electrode rod 19 movably disposed on a bellows 18. A shield plate 20 is disposed around contacts 11 and 12. In vacuum interrupter 10 described above, arc is developed between both of contacts 11 and 12 which are electrodes, during an interruption of the current. On the other hand, an arc current i is caused to flow from contact plate 2 into first coil portion 7*a* between each first slit 5 of contact carrier 1 and flow into second coil portion 7*b* between each first slit 5 and adjacent one of second slits 6, and into a third coil portion 7*c* between each second slit 6. The current flow through each coil portion 7*a*, 7*b*, and 7*c* causes a longitudinal magnetic field B to be developed. Since routes of arc currents are many and are long, a double magnetic field is developed as compared with a case wherein only first slits 5 are formed. Thus, the arcs can be stabilized. A favorable breaking performance can be obtained. It is noted that the current is not a flow denoted by a solid line in FIG. 1 but a flow on a bypass flow as denoted by a dot line shown in FIG. 1.

Next, vacuum interrupter 10 using the contact arrangement described above will be described below.

Vacuum interrupter 10 was manufactured with a dimension of each part of contacts 11 and 12 prescribed below. Outer diameter D of contact carrier 1=80 m. Length of contact carrier 1=27 mm. Number of slits S=12 (one side 6). Tilt angle α of each slit 5 and 6=70°. Azimuth angle γ between each slit 5 and 6=30°. A wall thickness W of contact carrier 1=8.5 mm.

The magnetic flux density developed at a center portion of the vacuum interrupter when a pair of contacts 11 and 12 are mutually opposed with each other at a distance (inter-contact distance G) on the same axle of contacts 11 and 12 is 3.8 μT/A.

According to the embodiment of this vacuum interrupter, a rated interrupt current of 31.5 KA and a rated voltage of 72 kV were achieved.

Furthermore, as another preferred embodiment of the vacuum interrupter using the contact electrode according to the present invention, the vacuum interrupter having the following dimension was produced. Outer diameter D of contact carrier 1=90 mm. Length L of contact carrier 1=37 mm. Number of slits S=12 (the number of slits of each contact is halved, i.e., 6). Azimuth angle γ of each slit α=75°. Azimuth angle β of each slit=13°. Wall thickness W of contact carrier 1=8.5 mm.

According to the embodiment of this vacuum interrupter according to the present invention, the magnetic flux density developed at a center portion of the vacuum interrupter is 30 μT/A. According to this vacuum interrupter, the breakage performance of rated voltage 72 kV–rated interrupt current of 40 KA was achieved.

The entire contents of a Japanese Patent Application No. 2001-276171 (filed in Japan on Sep. 12, 2001) are herein incorporated by reference. The scope of the invention is defined with reference to the following claims.

What is claimed is:

1. A contact arrangement for a vacuum interrupter, comprising:

a hollow cylindrical contact carrier on one end surface of which a contact plate is attached;

a plurality of first slits formed on the contact carrier from the one end surface of the contact carrier; and a plurality of second slits formed on the contact carrier from each predetermined point of midway through an axial direction of the contact carrier, each of the first and second slits being tilted with respect to the axial direction of the contact carrier, a coil portion being formed on a portion of the hollow cylindrical contact carrier between each of the first and second slits and an adjacent one of the first and second slits, and a longitudinal magnetic field being formed along the axial direction of the contact carrier by a current flowing on the coil portion.

2. The contact arrangement for a vacuum interrupter as claimed in claim 1, wherein each of the second slits is extended on the other end surface of the contact carrier.

3. The contact arrangement for a vacuum interrupter as claimed in claim 1, wherein a plurality of straight line third slits, each third slit being connected to a corresponding one of the first slits at the one end surface of the contact carrier, are extended inwardly through mutually equal angles on a surface of the contact plate.

4. The contact arrangement for a vacuum interrupter as claimed in claim 1, wherein the coil portion comprises: a first coil portion formed on a portion of the contact carrier between mutually adjacent first slits; a second coil portion formed on a portion of the contact carrier between each of the first and the second slits; and a third coil portion formed on a portion of the contact carrier between mutually adjacent second slits.

5. The contact arrangement for a vacuum interrupter as claimed in claim 1, wherein, when an outer diameter D of the contact plate is 60 mm≦D ≦200 mm, a length L of the contact plate is set to a value in a range of 0.2 D mm≦L≦D mm, the number of the first and second slits S is set to a value in a range of 0.1 D/mm≦S≦0.2 D/mm, a tilt angle a of each of the first and second slits with respect to the axial direction of the contact carrier is set to a value in a range of 60°≦α≦80° an azimuth angle β of each of the first and second slits is set to a value in a range of (540/S)°≦β≦(1440/S)°, and an azimuth angle γ between each of the first slits and adjacent one of the second slits is set to a value in a range of (120/S)°≦γ≦(600/S)°.

6. The contact arrangement for a vacuum interrupter as claimed in claim 5, wherein a wall thickness W of the contact carrier is set in a range of 6 mm≦W≦12 mm.

7. The contact arrangement for a vacuum interrupter as claimed in claim 1, wherein the first and second slits are extended between an outside surface of the carrier and an inner surface thereof and a hollow cylindrical reinforcement body is mounted along the inner surface of the contact carrier.

8. The contact arrangement for a vacuum interrupter as claimed in claim 1, wherein each of the first slits is formed from the one end surface of the contact carrier to another predetermined point of midway through the axial direction of the contact carrier, each of the second slits is formed from the predetermined point of midway through the axial direction of the contact carrier to the other end of the contact carrier, and, when a depth of the contact carrier from the one end surface of the contact carrier to the other end surface thereof is one, another depth from the one end surface of the contact carrier to the other predetermined point of midway through the axial direction of the contact carrier is approximately equal to a still another depth from the predetermined point of midway through the axial direction of the contact carrier to the other end surface of the contact carrier and is approximately equal to one-half.

9. A vacuum interrupter having a pair of contact electrodes arranged on the same axis in an evacuated envelope in a manner to connect or disconnect with each other by respective electrode rods, at least one contact electrode comprising:

a hollow cylindrical contact carrier on one end surface of which a contact plate is attached;

a plurality of first slits formed on the contact carrier from the one end surface of the contact carrier; and a plurality of second slits formed on the contact carrier from each predetermined point of midway through an axial direction of the contact carrier, each of the first and second slits being tilted with respect to the axial direction of the contact carrier, a coil portion being formed on a portion of the hollow cylindrical contact carrier between each of the first and second slits and an adjacent one of the first and second slits, and a longitudinal magnetic field being formed along the axial direction of the contact carrier by a current flowing on the coil portion.

10. The vacuum interrupter having a pair of contact electrodes arranged on the same axis in an evacuated envelope in a manner to connect or disconnect with each other by respective electrode rods as claimed in claim 9, wherein a distance G between each of the pair of contact electrodes when the pair of electrodes are disconnected is set to a value in a range of 15 mm$\leqq$G$\leqq$100 mm.

11. The vacuum interrupter having a pair of contact electrodes arranged on the same axis in an evacuated envelope in a manner to connect or disconnect with each other by respective electrode rods as claimed in claim 10, wherein each of the second slits is extended on the other end surface of the contact carrier.

12. The vacuum interrupter having a pair of contact electrodes arranged on the same axis in an evacuated envelope in a manner to connect or disconnect with each other by respective electrode rods as claimed in claim 10, wherein a plurality of straight line third slits, each connected to a corresponding one of the first slits at the one end surface of the contact carrier, are extended inwardly through mutually equal angles on a surface of the contact plate.

13. The vacuum interrupter having a pair of contact electrodes arranged on the same axis in an evacuated envelope in a manner to connect or disconnect with each other by respective electrode rods as claimed in claim 10, wherein the coil portion comprises: a first coil portion formed on a portion of the contact carrier between mutually adjacent first slits; a second coil portion formed on a portion of the contact carrier between each of the first and second slits; and a third coil portion formed on a portion of the contact carrier between mutually adjacent second slits.

14. The vacuum interrupter having a pair of contact electrodes arranged on the same axis in an evacuated envelope in a manner to connect or disconnect with each other by respective electrode rods as claimed in claim 9, wherein, when an outer diameter D of the contact plate is 60 mm$\leqq$D$\leqq$200 mm, a length L of the contact plate is set to a value in a range of 0.2 D mm $\leqq$L$\leqq$D mm, the number of the first and second slits S is set to a value in a range of 0.1 D/mm$\leqq$S$\leqq$0.2 D/mm, a tilt angle $\alpha$ of each of the first and second slits with respect to the axial direction of the contact carrier is set to a value in a range of $60° \leqq \alpha \leqq 80°$, an azimuth angle $\beta$ of each of the first and second slits is set to a value in a range of $(540/S)° \leqq \beta \leqq (1440/S)°$, and an azimuth angle $\gamma$ between each of the first slits and adjacent one of the second slits is set to a value in a range of $(120/S)° \leqq \gamma \leqq (600/S)°$.

15. The vacuum interrupter having a pair of contact electrodes arranged on the same axis in an evacuated envelope in a manner to connect or disconnect with each other by respective electrode rods as claimed in claim 14, wherein a wall thickness W of the contact carrier is set to a value in a range of 6 mm $\leqq$W$\leqq$12 mm.

16. The vacuum interrupter having a pair of contact electrodes arranged on the same axis in an evacuated envelope in a manner to connect or disconnect with each other by respective electrode rods as claimed in claim 10, wherein the first and second slits are extended between an outside surface of the carrier and an inner surface thereof and a hollow cylindrical reinforcement body is mounted along the inner surface of the contact carrier.

17. The vacuum interrupter having a pair of contact electrodes arranged on the same axis in an evacuated envelope in a manner to connect or disconnect with each other by respective electrode rods as claimed in claim 10, wherein each of the first slits is formed from the one end surface of the contact carrier to another predetermined point of midway through the axial direction of the contact carrier, each of the second slits is formed from the predetermined point of midway through the axial direction of the contact carrier to the other end of the contact carrier, and, when a depth of the contact carrier from the one end surface of the contact carrier to the other end surface thereof is one, another depth from the one end surface of the contact carrier to the other predetermined point of midway through the axial direction of the contact carrier is approximately equal to a still another depth from the predetermined point of midway through the axial direction of the contact carrier to the other end surface of the contact carrier and is approximately equal to one-half.

* * * * *